US006426728B2

(12) United States Patent
Petersson

(10) Patent No.: US 6,426,728 B2
(45) Date of Patent: Jul. 30, 2002

(54) ANTENNA OF WAVEGUIDE TYPE FOR RECEIVING SATELLITE SIGNALS

(76) Inventor: Stig Anders Petersson, Hökmark 1585, SE-93010, Lövånger (SE)

( * ) Notice: Subject to any disclaimer, the term of this patent is extended or adjusted under 35 U.S.C. 154(b) by 0 days.

(21) Appl. No.: 09/797,704

(22) Filed: Mar. 5, 2001

Related U.S. Application Data

(63) Continuation of application No. PCT/SE99/00868, filed on May 20, 1999.

(30) Foreign Application Priority Data

May 20, 1998 (SE) ..... 9801830

(51) Int. Cl.[7] ..... H01Q 13/00

(52) U.S. Cl. ..... 343/772; 343/776; 343/909; 343/912

(58) Field of Search ..... 343/772, 774, 343/776, 786, 909, 912

(56) References Cited

U.S. PATENT DOCUMENTS 2,599,763 A 6/1952 Kock ..... 250/33.63
5,909,191 A * 6/1999 Hirshfield et al. ..... 342/174
6,087,999 A * 7/2000 Muhlhauser et al. ..... 343/753
6,281,853 B1 * 8/2001 Caille et al. ..... 343/754

FOREIGN PATENT DOCUMENTS

WO WO9411920 5/1994

* cited by examiner

*Primary Examiner*—Don Wong
*Assistant Examiner*—Shih-Chao Chen
(74) *Attorney, Agent, or Firm*—Birch, Stewart, Kolasch, & Birch, LLP

(57) ABSTRACT

An antenna suited for receiving/transmitting electromagnetic signals from/to at least two satellites, which are fixedly placed at points on the geostationary path, is waveguide or lens type, formed by a multitude of waveguiding channels, which for example can be rotationally symmetrically arranged about an axis. Signals from remote points, which arrive in directions somewhat deviating from the direction of the axis, e.g. in an angle $\alpha_{in}$ thereto, exit after being refracted in the antenna in a different direction, so that the angle $\alpha_{ut}$ on the exit side differs from the angle $\alpha_{in}$ on the entrance side. It is achieved by having all of the waveguiding channels form suitably adapted angles to the axis. For a concave antenna it can give an increased separation between the positions, to which signals from remote objects are refracted by the antenna. It results in, for example, large more efficient receiver horns being used for the same size of the antenna.

24 Claims, 2 Drawing Sheets

ANTENNA OF WAVEGUIDE TYPE FOR RECEIVING SATELLITE SIGNALS

This application is a Continuation of PCT/SE99/00868, filed May 20, 1999.

TECHNICAL FIELD

The present invention relates to an antenna of waveguide type which is particularly suited to receiving/transmitting signals from/to several geostationary satellites and it further relates to a method of manufacturing such an antenna.

BACKGROUND

Today a multitude of satellites are fixedly placed in the so called geostationary path. Such a satellite is located at a substantially fixed point above the surface of the earth, straightly above a fixed point on the equator. These satellites transmit or forward, in addition to other information, television signals which are intended for private homes, premises or apartments and which are usually received by means of paraboloidal antennas placed directly in the vicinity of the place where the signal is to be used for showing television.

Paraboloidal antennas or aerials, commonly called parabolic reflectors or satellite dishes, of varying sizes are available. In order to distinguish between two satellites which are located at an angular distance of 3° from each other as seen from the receiver and which for example transmit using frequencies in the range of 10–12 GHz, a paraboloidal antenna must have a diameter of 60 cm to eliminate mutual interference between signals received from two such satellites. In a paraboloidal antenna having such a size a considerable problem resides in that there is no physical space between the two focal points on which two such adjacent satellites are imaged in order to place the two receiver horns at the focal points. Such receiver horns should have a diameter of 36–42 mm and it appears that the distance between focal points obtained when receiving signals from satellites located so close to each other is significantly smaller than this preferred least diameter of the horns. A paraboloidal antenna suited to receiving signals from satellites having such an angular distance of each other must then be given a larger focus distance, i.e. the distance from each focal point to the center of the paraboloidal antenna must be made larger. Then also all of the paraboloidal antenna must be made significantly larger than the size required for obtaining the signal strength at the focal points which is required for only distinguishing between the signals so that the signals when receiving them will not interfere with each other.

An alternative to paraboloidal antennas comprises antennas of lens character or waveguide type, see e.g. the published International patent application WO 94/11920 A1 and U.S. Pat. No. 2,599,763. When using such an antenna for receiving from two satellites which are located at some angular distance of each other as seen from the receiver, the focal points on which these satellites are imaged are located at the same angular distance as seen from the center of the antenna. However, also in this case the focal distance must be made sufficiently long, in order that there will be sufficient space for the two microwave horns to be located at each other. Since microwave horns for receiving signals having a frequency of for example 11 GHz are less efficient if they have diameters smaller than 40 mm, it is advantageous to place the imaged points, which are obtained when receiving signals from two satellites having an angular distance of 3° of each other, at a distance of at least 40 mm from each other. However, the focal distance of the antenna will then be larger than 800 mm.

SUMMARY OF THE INVENTION

It is an object of the invention to provide a receiver device for microwave signals from for example satellites allowing simultaneous reception of signals having directions of 2–3° from each other in a relatively small antenna.

This and other objects are achieved with a particularly designed antenna which can give a magnification or reduction of the incidence angles of incoming signals.

An antenna of waveguide character suited for receiving/transmitting electromagnetic signals from/to at least two satellites which are fixedly placed at points in the geostationary path has in the common way waveguiding channels. These channels are given such a shape that a separation of the signals is achieved for a shorter focal distance, what for the receiving case will mean a magnification of the angles of incidence. Thereby an increased distance from each other of the focal points for signals from adjacent satellites is obtained. It is also possible to design the waveguiding channels in the antenna so that a reduction of the angles of incidence is obtained if it would be desired.

The characteristic feature of antennas of waveguide type is that an electromagnetic wave passing through such an antenna passes through the antenna in a way similar to that of light passing through an optical lens. In such antennas waveguiding channels are provided which according to the prior art are parallel to the optical axis of the antenna and have varying lengths, diameters and inclinations of wall portions, see the above cited International patent application WO 94/11920 and the prior art described or cited therein. In the cited U.S. patent some channels can be said not to be parallel to the axis but they still work like the other channels being parallel to the axis. In a first embodiment of an antenna of waveguide or lens type considered herein the waveguiding channels are symmetrically placed about the optical axis of the antenna and which, for channels at the same distance of the axis, have the same length, i.e. the antenna is basically rotationally symmetric. In a second embodiment antennas of waveguide guide include waveguiding channels of the same basic type which are not rotationally symmetrically placed and such antennas can also be adapted to give the same effect comprising a magnification or a reduction of the angles of incidence.

The waveguiding channels are generally arranged about an axis of the antenna and produce, when the antenna is used for receiving electromagnetic signals, images of remote objects on focal points located in a focal plane, the true focus of the antenna being the focal point located on the antenna axis. All of the waveguiding channels form angles to the axis which angles are adapted, so that an electromagnetic signal from a remote object arrives to the antenna in a direction forming a first angle to the axis, after passing through the antenna and being refracted therein leaves the antenna in a second angle to the axis different from the first angle. The direction of a signal from a remote object is perpendicular to the flat wavefronts of the signal. After passing through the antenna the signal can obtain substantially spherical wavefronts and the direction of the signal is then defined as the center or symmetry line of the wavefronts. The waveguiding channels have all substantially the same cross-section. They are made as channels having a substantially uniform cross-section over the lengths of the channels except for the entrance and exit regions of the channels which may be tapering to form horn structures. The direction of a channel is given by the center line of the channel, in particular of the region of the channel having the substantially uniform cross-section. The angle of a waveguiding channel can be taken as defined by a straight line connecting the center of an entrance opening of the channel with the center of an exit opening.

The waveguiding channels can be curved and then the center lines thereof e.g. all have a convex polygon shape. Such a center line will generally be located in a plane through the antenna axis. The openings of the waveguiding channels at the exit side, i.e. the parts of the waveguiding channels located close to the exit side, are advantageously directed substantially in a direction towards the true focus of the antenna. Thus said center line of a channel can at the exit side have a direction pointing to the focus. The waveguiding channels, i.e. principally their center lines, can extend substantially along the path of an elementary ray of a signal passing through the antenna, in the refraction of the signal in the antenna.

BRIEF DESCRIPTION OF THE DRAWINGS

The invention will now be described by way of non-limiting embodiments with reference to the accompanying drawings, in which.

DESCRIPTION OF PREFERRED EMBODIMENTS

Figure 1:
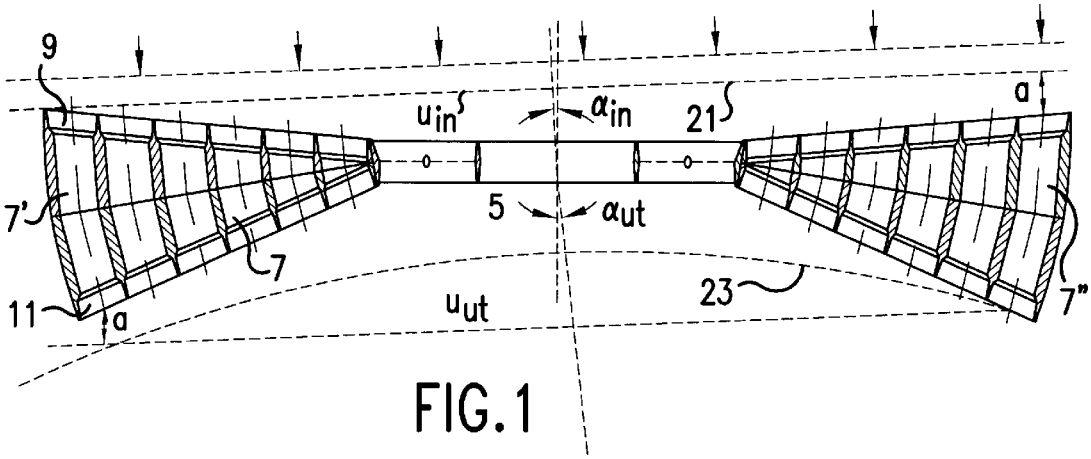
FIG. 1 is a cross-section of a rotationally symmetric antenna of waveguide character.
Figure 2:
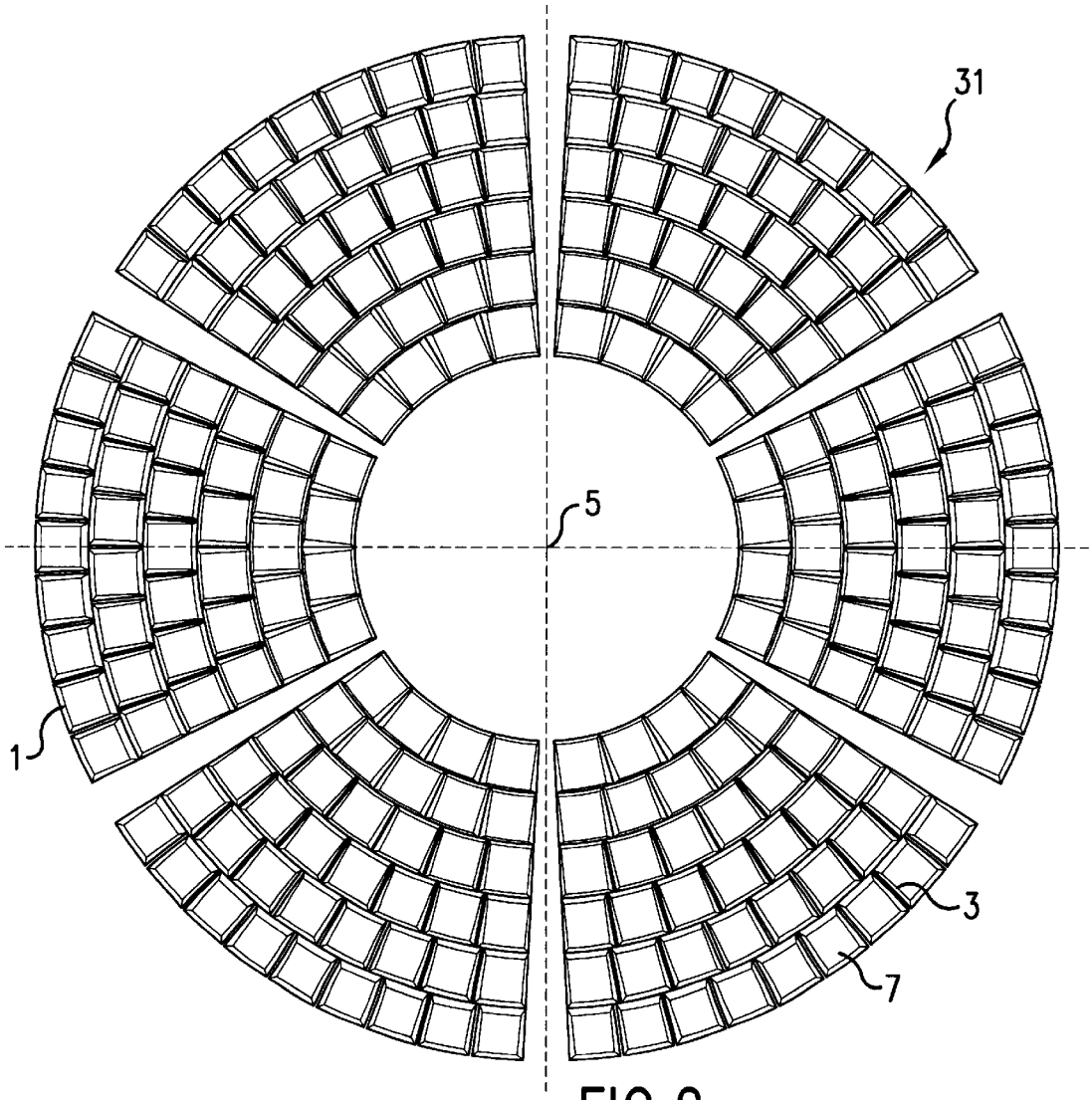
FIG. 2 is a front view of the antenna shown in FIG. 1.

An antenna of waveguide type includes a plurality of waveguiding, particularly designed channels which are located at each other and guide an incoming electromagnetic wave towards a focal point. Such an antenna is shown in the views of FIGS. 1 and 2 and is the basic rotationally symmetric type is described in the International patent application cited above. The antenna shown includes six concentric rings 1 which are placed outside each other and are divided by partitioning walls 3 placed along radii extending from the axis 5 of the antenna in order to form a relatively large number of waveguiding channels 7 having approximately equally large dimensions as seen in transverse directions. The rings 1 and the partitioning walls 3 are made of a metallic, electrically well conducting material at at least their surfaces. A preferred material can be a metallized artificial resin material. The entrance opening and the exit opening of each channel 7 can be provided with horns, i.e. suitably designed tapering regions 9, 11 which in the radiation direction get narrower or widens respectively. This presupposes that the material of the rings 1 and the partitioning walls 3 has some thickness which additionally provides some distance between adjacent waveguiding channels and allows the special design to be described hereinafter.

The antenna shown in FIG. 1 is the concave type having a flat side, to which normally an electromagnetic wave is incident and which therefore can be called the entrance side of the antenna. The opposite side of the antenna can be called the exit side and has a concave shape, so that the exit side or surface of the antenna obtains a cup shape. Thus, the total antenna is narrower at its center region and the waveguiding channels 7 between two considered rings 1 are longer than channels, which are located closer to the axis 5 of the antenna.

By designing the inner and outer sides of the rings 1 as envelope surfaces of suitably chosen frustums of circular, straight cones having the same axis 5 each waveguiding channel 7 can be made to incline in relation to the optical axis of the antenna, which simultaneously is the geometric axis thereof, i.e. the geometric axis 5 of the rings 1. The center lines of the waveguiding channels are thus not parallel to the symmetry axis 5 and to each other. The opening of a waveguiding channel 7 at one surface or side of the antenna is then located at a first distance of the axis 5 and the opening of the same channel at the other, opposite surface or side of the antenna is located at a second distance of the axis 5, the second distance being different from the first distance.

Furthermore, for suitable dimensions the ratio of the distance from the center of the opening of a waveguiding channel at one side of the antenna to the lens axis 5 and the corresponding distance for the opening at the opposite side can be made constant for waveguiding channels 7 formed between different rings 1. It can particularly easily be obtained for a concave antenna, for which the lengths of the waveguiding channels 7 increase with the distance from the lens axis 5. Further, the fulfilment of this condition is particularly facilitated by making the material in the rings 1 not too thin.

This arrangement achieves that a signal, incoming from a remote point and a little obliquely in relation to the antenna and considered as a ray, will experience an angular deflection when passing the antenna. The angle of the incoming ray in relation to the axis of the antenna thus differs from that of the exiting ray. The amount in which this angle is changed is proportional to the previously described ratio between the radial positions at one side and at the opposite side. If the channels for example have openings located at shorter radial distances on the side at which the focus is situated an angle magnification is obtained, the size of the magnification being given by known laws of geometry and physics.

Hence, consider a flat wavefront 21 incoming to the flat side of the antenna, the incident direction of which forms a rather small angle to the axis 5 of the antenna. The wavefront first hits a channel 7' located between the outermost rings. The distance of the wavefront at this instant to the opening of the waveguiding channel 7" located diametrically opposite between the outermost rings 1 can be denoted by a. The electromagnetic wave then passes through the waveguiding channels 7, is then refracted in the antenna and forms at the opposite concave side of the antenna, at the exit from the antenna, an approximately spherical wavefront 23. Exactly at the moment when this spherical front completely leaves the antenna, i.e. when it exits from said channel 7" located diametrically opposite, it has a distance of similarly a from the exit opening of the first considered channel 7', the channel, which was first hit by the flat wavefront. However, the distance between the exit openings at the exit side differs from the distance at the entrance side and thereby an angular deflection is obtained which approximately, for small incident angles, is proportional to the quotient of these distances. If the angle of incidence of the wavefront is $\alpha_{in}$, the exit angle of the wavefront is $\alpha_{ut}$, the distance between the centers of the entrance openings of two diametrically opposite channels between the same rings is $u_{in}$ and the corresponding distance between the exit openings is $U_{ut}$, the exit angle of the wavefront, i.e. the angle of the direction of the wavefront to the antenna axis, is approximately given by $$\alpha_{ut}=\alpha_{in}\cdot(u_{in}\cdot u_{ut})$$

Thus, if $u_{ut}$ is smaller than $u_{in}$, a magnification is obtained. For example the dimensions $u_{ut}$=200 and $u_{in}$=220 gives a magnification of the angle 3° to an angle of about 3.5°.

The antenna shown in FIG. 1 can naturally also be used to provide a reducing effect, and then the wavefront can arrive to the side, which has above been called the exit side. It can also be used as an antenna having transmitting devices placed in the focal region.

In order to enhance the radiation characteristics of the individual waveguiding channels, and thereby the overall efficiency of the antenna, the ends and the horn-shaped openings of the waveguides can be directed in the preferred radiation direction. This means that the waveguiding channels will be designed to have curved configurations along substantially the individual ray paths of the antenna. As is illustrated in FIG. 1, it can be achieved by instead forming the inner side and the outer side of each circular ring from two neighbouring envelope surfaces which connect to each other and which belong to the frustums of two straight circular cones, the cone angles of two such cones differing somewhat from each other. The inner and outer walls of the channels can of course also be composed of more envelope surfaces of this type.

In order to manufacture the antenna of waveguide character as described above the antenna is divided into sectors 31, for example as is illustrated in FIG. 2 in six symmetric sectors. Each such sector 31 is symmetric about its radially extending center plane and can further be divided into two halves 33 along the fictitious partition surface 35 which separates the parts of the waveguiding channels at one side of the antenna from the parts at the opposite side and which is also a sector of an envelope surface of a frustum of a cone. Each such half of a sector 33 then has waveguiding channels which extend in parallel and can therefore easily be series produced in for example an artificial resin machine. Furthermore, one surface of each sector 31 is flat what facilitates mounting the sectors to produce the whole antenna.

The ratio of the distance from the entrance opening of a waveguiding channel to the axis and the distance from the exit of the same waveguiding channel to the axis is according to the discussion above approximately constant. Small variations can exist owing to the fact that the partition surface between the halves of sectors 33 has the shape of the envelope surface of a frustum of a straight, circular cone. The lens can also be constructed from small sectors which only comprise a single channel and the material located at and about the channel. If the lens is constructed from small sectors having flat front and rear surfaces the rear surface of the lens will have a shape including facets.

Owing to the facet shape a somewhat longer distance can be obtained to the focal point, to which incoming flat wavefronts are refracted, but this deviation is insignificant in relation to the focal distance and therefore only gives a small variation of the degree of magnification. A compensation of the fact that the facet edge is located farther away from the focal point can in addition, if desired, be obtained by a suitable dimensioning of the channels most adjacent to these edges.

In an exactly dimensioned antenna or lens the two halves 33 of a sector 31 are differently designed, see FIG. 2. A whole sector can be produced by a molding process, for example injection molding. Then a molding tool is used which includes a pair of movable cores for each channel, so that one core extends from the front surface and the other core for forming the same channel extends from the rear surface. After molding one molded piece, the cores are extracted whereafter other portions of the mold are removed. Then a problem may arise when the cores on the side of the sector which is part of a conical surface are to be extracted, since they can collide with each other in the extraction movement. However, every second core on this side can be first extracted a rather long distance and then the other ones a shorter distance. The cores of the holes on the conical side can thus be removed alternatingly and then have space to be moved inwards, towards each other.

Figure 3:
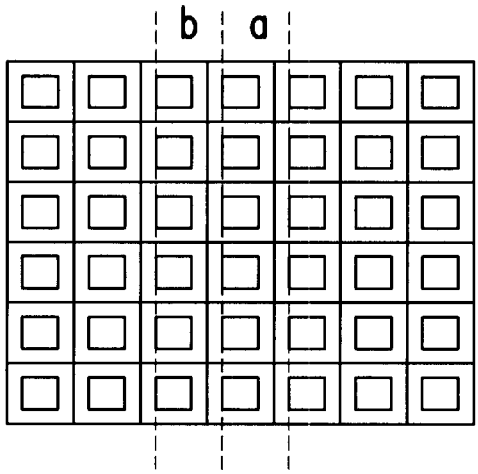
FIG. 3 is a front view of an antenna of waveguide character which is not rotationally symmetric.
Figure 4:
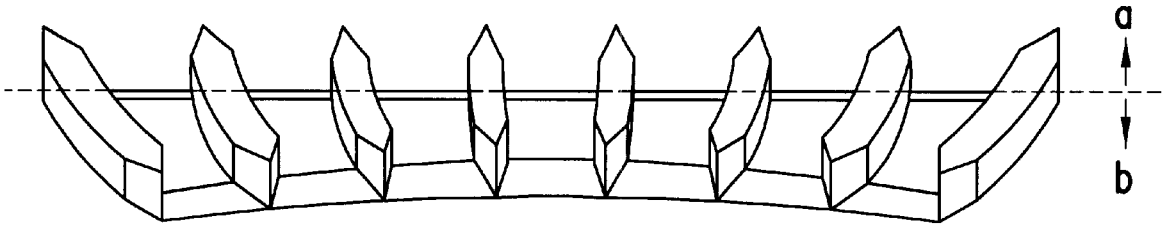
FIG. 4 is a perspective view of section used in building an antenna of the type shown in FIG. 3.

An antenna of waveguide character which is not rotationally symmetric is shown as seen from the front in FIG. 3 or from the rear side but then in a different scale. It includes a plurality of channels which are here arranged in a rectangular pattern. Each channel is as above designed to forward incoming waves towards a focal point with a deflection, by the fact that the channels are located in an angle to the optical axis of the antenna and for example comprise two portions, which form a small angle to each other. In the manufacture this antenna can be produced from separate sections, which for example each one includes a row of channels located straightly above each other, in a vertical plane. Advantageously a section can be formed by the region between two parallel planes which extend approximately centrally through the channels in two neighbouring rows of channels. The antenna is symmetric in relation to a horizontal center plane and a vertical center plane, what results int that separate sections at the same distance from the vertical center plane are identical. A typical such section is shown in the perspective view of FIG. 4. It can easily be produced in molding tool since the channels are cut-through and have no under-cut surfaces and therefore no movable cores are required.

Above a device primarily intended for receiving signals has been described. However, the device can easily be modified for transmitting signals by replacing the reception microwave horns by transmission horns while preserving the positions of the horns, since ray paths of electromagnetic waves are invertible according to the laws of physics.

What is claimed is:

1. An antenna of waveguide type for receiving/transmitting electromagnetic signals, the antenna comprising:

a plurality of waveguiding channels arranged about an axis of the antenna, each of the waveguiding channels having:

a first opening and a second opening, all first openings being located at one side of the antenna and all second openings being located at an opposite side of the antenna, and a direction defined by a straight line connecting the center of the first opening of the channel to the center of the second opening, wherein the directions of all the waveguiding channels form angles to the axis of the antenna, and the quotient of the distance from the first opening of a waveguiding channel to the antenna axis and the distance from the second opening of the waveguiding channel to the antenna axis has substantially the same value for all waveguiding channels, said angles producing, when receiving electromagnetic signals, images of remote objects on focal points, so that an electromagnetic signal from a remote object, which electromagnetic signal has a flat wavefront and arrives at the antenna at a first angle to the axis of the antenna, after passing through the antenna and being refracted therein leaves the antenna at a second angle to the axis of the antenna different from the first angle.

2. The antenna of claim 1, wherein the directions of the waveguiding channels all form substantially the same angle to the axis of the antenna.

3. The antenna of claim 1, wherein each of the waveguiding channels has a cross-section that is substantially uniform over the length of the channel.

4. The antenna of claim 1, wherein the waveguiding channels all have substantially the same cross-section.

5. The antenna of claim 1, wherein the directions of the waveguiding channels have such angles to the axis of the antenna and the waveguiding channels have such a shape that the quotient of the value of the second angle and the value of the first angle is substantially constant for small values of the first angle.

6. The antenna of claim 1, wherein the openings of the waveguiding channels at an exit side of the antenna are directed substantially in a direction towards the true focus of the antenna.

7. The antenna of claim 1, wherein the waveguiding channels extend substantially along an elementary ray path of a signal passing through the antenna, in the refraction of the signal in the antenna.

8. An antenna of waveguide type for receiving/transmitting electromagnetic signals, the antenna comprising:

a plurality of waveguiding channels arranged about an axis of the antenna, each of the waveguiding channels having:

a first opening and a second opening, all first openings being located at one side of the antenna and all second openings being located at an opposite side of the antenna, a direction defined by a straight line connecting the center of the first opening of the channel to the center of the second opening, and a cross-section that is substantially uniform over the length of the channel, wherein the directions of all the waveguiding channels form angles to the axis of the antenna, and the waveguiding channels are curved, said angles producing when receiving electromagnetic signals, images of remote objects on focal points, so that an electromagnetic signal from a remote object, which electromagnetic signal has a flat wavefront and arrives at the antenna at a first angle to the axis of the antenna, after passing through the antenna and being refracted therein leaves the antenna at a second angle to the axis of the antenna different from the first angle.

9. The antenna of claim 8, wherein the waveguiding channels have center lines of a polygon shape.

10. The antenna of claim 9, wherein each of the center lines is located in a plane through the axis of the antenna.

11. The antenna of claim 8, wherein the directions of the waveguiding channels all form substantially the same angle to the axis of the antenna.

12. The antenna of claim 8, wherein each of the waveguiding channels have a cross-section that is substantially uniform over the length of the channel.

13. The antenna of claim 8, wherein the waveguiding channels all have substantially the same cross-section.

14. The antenna of claim 8, wherein the directions of the waveguiding channels have such angles to the axis of the antenna and the waveguiding channels have such a shape that the quotient of the value of the second angle and the value of the first angle is substantially constant for small values of the first angle.

15. The antenna of claim 8, wherein the openings of the waveguiding channels at an exit side of the antenna are directed substantially in a direction towards the true focus of the antenna.

16. The antenna of claim 8, wherein the waveguiding channels extend substantially along an elementary ray path of a signal passing through the antenna, in the refraction of the signal in the antenna.

17. An antenna of waveguide type for receiving/transmitting electromagnetic signals, the antenna comprising:

a plurality of waveguiding channels arranged about an axis of the antenna, each of the waveguiding channels having:

a first opening and a second opening, all first openings being located at a first side of the antenna and all second openings being located at a second, opposite side of the antenna, a direction defined by a straight line connecting the center of the first opening of the channel to the center of the second opening, and a cross-section that is substantially uniform over the length of the channel, wherein the directions of all the waveguiding channels form angles to the axis of the antenna, and each of the waveguiding channels includes a first portion at the first side of the antenna and a second portion at the second side of the antenna, the first portion and the second portion each constituting substantially straight waveguides, which have center lines forming different angles to the axis of the antenna, said angles of the directions of the waveguiding channels to the axis of the antenna producing, when receiving electromagnetic signals, images of remote objects on focal points, so that an electromagnetic signal from a remote object, which electromagnetic signal has a flat wavefront and arrives at the antenna at a first angle to the axis of the antenna, after passing through the antenna and being refracted therein leaves the antenna at a second angle to the axis of the antenna different from the first angle.

18. The antenna of claim 17, wherein the directions of the waveguiding channels all form substantially the same angle to the axis of the antenna.

19. The antenna of claim 17, wherein each of the waveguiding channels has a cross-section that is substantially uniform over the length of the channel.

20. The antenna of claim 17, wherein the waveguiding channels all have substantially the same cross-section.

21. The antenna of claim 17, wherein the directions of the waveguiding channels have such angles to the axis of the antenna and the waveguiding channels have such a shape that the quotient of the value of the second angle and the value of the first angle is substantially constant for small values of the first angle.

22. The antenna of claim 17, wherein the openings of the waveguiding channels at an exit side of the antenna are directed substantially in a direction towards the true focus of the antenna.

23. The antenna of claim 17, wherein the waveguiding channels extend substantially along an elementary ray path of a signal passing through the antenna, in the refraction of the signal in the antenna.

24. A method of manufacturing an antenna of waveguide type for receiving/transmitting electromagnetic signals comprising the step of:

producing a plurality of waveguiding channels extending in a symmetric arrangement about an antenna axis, to produce, when the antenna is used for receiving, images of remote objects on focal points, wherein, in the step of producing the waveguiding channels, all the waveguiding channels are given angles to the antenna axis, sectors are produced containing the waveguiding channels, and the sectors are attached to each other at radially located sides of the sectors.

* * * * *